United States Patent [19]

Arias L.

[11] 4,408,409

[45] Oct. 11, 1983

[54] AMMUNITION MAGAZINE PACKAGE COMBINATION

[76] Inventor: Adolfo Arias L., Box 741, Panama, Panama

[21] Appl. No.: 237,712

[22] Filed: Feb. 24, 1981

[51] Int. Cl.[3] ..... F41C 25/02

[52] U.S. Cl. ..... 42/50

[58] Field of Search ..... 42/50

[56] References Cited

U.S. PATENT DOCUMENTS

| | | | |
|---|---|---|---|
| 2,773,325 | 12/1956 | Hill | 42/50 |
| 2,910,795 | 11/1959 | Agren | 42/50 |
| 3,087,270 | 4/1963 | Stoner | 42/50 |
| 3,603,020 | 9/1971 | Wiese | 42/50 |
| 3,636,647 | 1/1972 | Goldin | 42/50 |
| 4,226,041 | 10/1980 | Goodworth | 42/50 |

*Primary Examiner*—Charles T. Jordan

*Attorney, Agent, or Firm*—Antonelli, Terry & Wands

[57] ABSTRACT

An ammunition magazine package for use in rifles wherein the magazine can be sold as a package fully loaded with ammunition and hermetically sealed. The magazine is constructed so as to be either reusable or disposable after all of its cartridges have been dispensed. The magazine can be made from a plastic material and have at one end a tear-off seal integrally connected at the cartridge dispensing end of the magazine. After the seal is torn-off, the ammunition can be dispensed into a firearm chamber.

15 Claims, 4 Drawing Figures

AMMUNITION MAGAZINE PACKAGE COMBINATION

BACKGROUND OF THE INVENTION

The present invention relates to a novel magazine for feeding cartridges into a rifle or other small arms where magazines are used. More particularly, the present invention is directed to an inexpensively manufactured magazine unit or package which is assembled fully loaded with ammunition and which includes a tear-off seal.

The use of magazines for rifles and other barreled weapons is, of course, very well known. However, the known types of magazines have several disadvantages. For instance, conventional magazines are often made of metal and thus are relatively expensive to manufacture. Some magazines are made from plastic material. These magazines are usually sold without the ammunition already loaded therein; if the ammunition is included in the magazine, the user can never be certain that all the rounds of ammunition have been loaded into the magazine or that the ammunition has not been tampered with prior to coming into his possession.

In order to be more economical, these magazines are usually reused. Thus, they must be open at one end in order to reload the ammunition. However, this arrangement has the disadvantage of allowing external elements, such as dirt or water, to enter into the magazine if the magazine is dropped. This may affect either the cartridge or the operation of the rifle itself. Moreover, each subsequent reloading of the magazine must occur by hand or by machine which, in any event, takes up more time and effort than is desired.

Furthermore, packages with tear-off seals are conventional for various types of products. However, prior to my invention, no one has devised a package with a tear-off seal which also has the dual function of functioning as a firearm magazine which can but need not be disposable.

SUMMARY OF THE INVENTION

The foregoing disadvantages have been overcome in accordance with the present invention by providing a magazine for feeding ammunition into a rifle or other appropriate small arm, which magazine is made from a low cost and easily fabricated material such as plastic and which magazine also serves as a disposable package unit for commercially handling the ammunition cartridges contained inside the magazine unit.

The foregoing objects and advantages have also been achieved by providing a magazine-package combination which has a tear-off seal integrally connected at the cartridge dispensing end of the magazine so as to hermetically seal the magazine package while the seal is still intact and before it is to be used in a weapon. The removal of the tear-off seal at the cartridge dispensing end of the package in accordance with the present invention further allows for ejecting and feeding of the cartridges into a rifle at the appropriate time.

The magazine-package unit according to the present invention is assembled fully loaded with the ammunition and is designed to be manufactured very inexpensively. Such a combination has the advantage of being very cost competitive with ammunition and magazines which are now being sold as separate items in the market and at a much higher combined price. The magazine unit of the present invention provides a further advantage that it can be reused, if so desired, or disposed of after the cartridges have been expelled therefrom.

It will be readily apparent to those skilled in this art from the following detailed description that the magazine unit in accordance with the present invention serves as a new packaging concept for selling ammunition commercially and, at the same time, protects the ammunition during handling and shipping. While the tear-off seal is still intact, the unit is fully hermetic and prevents mud, dirt, humidity, and the like from getting inside the magazine, thereby minimizing a potential problem of the cartridges jamming inside the magazine. This also has the advantage of allowing the rifle to operate more cleanly and reduce any fouling and maintenance problems.

When the unit is made of plastic, it is totally rust-proof except for the metal spring. Even the spring can be made rust proof, if desired, within the scope of my invention. Moreover, a plastic magazine is highly resistant to impact forces, since a properly chosen plastic material will be yieldable and will not dent as is the case with metal magazines. This, in turn, prevents any damage to the cartridges from impact blows as well as jamming of the ammunition from the dent in the magazine.

With the use of a tamper proof tear-off seal, the purchaser of the ammunition can feel assured that there has been no tampering with the ammunition between the point of manufacture of the magazine and the point of purchase. Likewise, the seal acts as a guarantee of the manufacturer against alteration of the contents.

I also contemplate that when the magazine is made of plastic, the cartridges slide more easily and are ejected more easily than in a metal magazine because there is less friction. Thus, the rifle will operate more smoothly than it does with metal clips. Furthermore, with plastic magazines, the unit can be manufactured in any color desired to achieve any type of camouflage tone. Whereas metal magazines must be painted, the color in a plastic magazine, being part of the composition, will not peel off or fade away.

Finally, the magazine according to my invention can be reused, if necessary or desired, and loaded manually. It also has the flexibility of being disposable because the magazine itself is low cost. A very important feature of my invention is that the magazine, when made of plastic or other light-weight material, is easier for the user to carry over long distances, especially when a fairly large number of clips are to be carried.

BRIEF DESCRIPTION OF THE DRAWING

These and further features, objects and advantages of my invention will become more apparent from the following description when taken in conjunction with the accompanying drawing which shows, for purposes of illustration only, a preferred embodiment of my invention and more particularly.

DETAILED DESCRIPTION OF A PREFERRED EMBODIMENT

Figure 1:
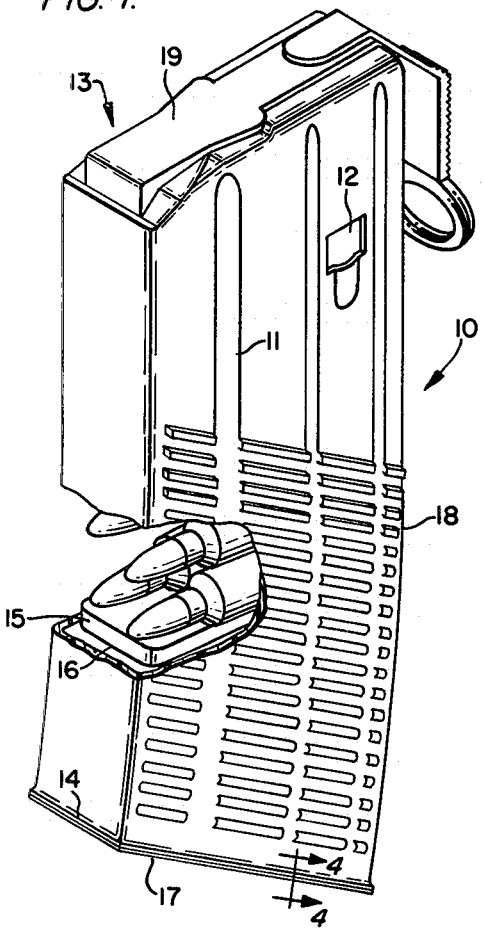
FIG. 1 is a perspective view of the novel magazine wherein a portion of the magazine has been cut-away to show some of the internal details which are of the generally known construction.
Figure 2:
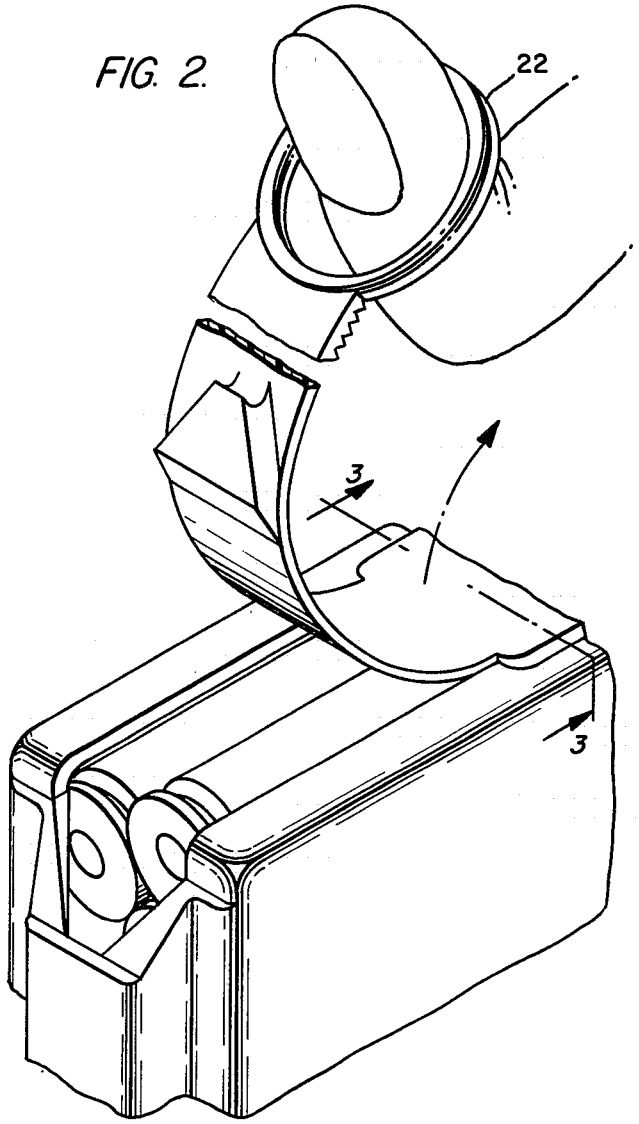
FIG. 2 is a perspective view at the cartridge ejecting end of the magazine wherein the user is in the process of removing the tear-off seal and (showing the ammunition inside)
Figure 3:
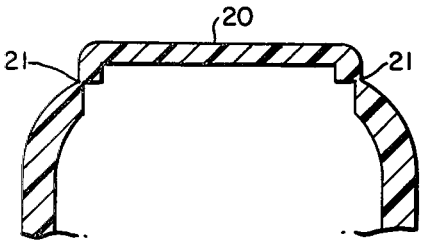
FIG. 3 is a cross-sectional view along lines 3—3 in FIG. 2.
Figure 4:
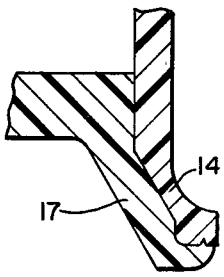
FIG. 4 is a cross-sectional view along a bottom portion of the magazine showing the locking cap and energy director.

Referring now to the drawing and, in particularly, to FIG. 1, there is shown a magazine-package unit in accordance with my invention designated generally by the numeral 10 and designed to fit a particular type or class of firearm. It is to be clearly understood that the magazine in accordance with my invention can be so dimensioned or designed so as to fit any rifle or other firearm adapted to use a magazine and to be usable with any cartridge. Certain features of this magazine unit are conventional and will be described generally as follows. The magazine has longitudinal indented portions 11 running along its length. These portions function as side contact guides for the cartridges and make it easier for to slide in exact alignment. The magazine also has a rectangular window-like indenture 12 on one of its faces. This indenture acts as a snap grip between the magazine and the rifle. The magazine with its tear-off seal 13 (to be described more fully hereinbelow) are manufactured as an integral unit. Cartridges are then inserted inside of the magazine 10 from the opening 14 at the bottom. The cartridges rest in angled layers on top of each other in the usual manner. Anywhere from ten to fifty rounds of ammunition are usually inserted into a magazine; however, magazines can be constructed to hold any quantity of cartridges desired, as well as any caliber desired. After the ammunition is inserted into the magazine, a plunger 15 is then inserted so as to press against the last layer of cartridges. A compression spring 16 is attached to the plunger so as to bias the column of ammunition toward the cartridge ejecting end of the magazine. When the tear-off seal is removed, the spring 16 will assist in ejecting the bullets from the magazine by virtue of the spring biasing force. A locking cap 17 is then snapped into the lower open end of the magazine unit. I have found it to be particularly desirable to hermetically close this lower locking cap 17 by the use of ultrasonic welding. This is accomplished by having a longitudinal triangular shaped protuberance or bead of plastic material having the same composition as the locking cap 17 (this bead being known as an "energy director") around the periphery of the lower locking cap 17 and then applying known ultrasonic welding techniques to cause the energy director to melt through frictional heat and thereby stick or weld to the other contacting surface on the magazine itself. After the lower cap 17 is ultrasonically welded, the magazine unit according to my invention is hermetically sealed.

If the magazine body is to be made from plastic or similar material, I have found it desirable to provide reinforcing ribs 18 on the sides of the magazine body. These reinforcing ribs act as structural members which allows a further reduction in wall thickness while adding strength to those walls. As a result, the walls will not be bulged outwardly due to the inner side pressure of the cartridges on the wall. These reinforcing ribs are provided only along the lower portion of the magazine and improve the grip on the magazine while the upper wall section of the magazine is allowed to remain smooth for fitting easily inside the rifle feeding entry.

In accordance with my present preferred embodiment of the invention, the magazine tear-off seal 13 is a piece of plastic material 19 which is an integral part of the magazine body itself and which totally covers the cartridge dispensing end of the magazine. Thus, when the tear-off seal is removed, there is an opening of the appropriate size to allow for effective ejection of the cartridges into the rifle. I have found it desirable to have the tear-off seal thicker along the center portion 20 and thinner at a web portion 21 which defines the contour edge of the cartridge dispensing end. I have found a web thickness of between 0.002 inches to 0.010 inches to be particularly effective for providing a seal that will tear-off easily. The tear-off portion is also provided with a pull tab 22 which in this embodiment is in the form of a ring to allow convenient insertion of a finger of the human hand for pulling the seal off from the magazine. However, it is to be understood that other types of tabs may be used without departing from the scope of my invention. With an appropriately designed tear-off seal, the seal breaks on one end and then follows smoothly along the contour until reaching the other end where it is totally pulled off away from the magazine itself and discarded.

As previously mentioned, the tear-off seal and the magazine body are molded in one piece from a plastic material. The magazine with its tear-off seal can be manufactured with various types of plastic resins such as glass reinforced nylon, ABS, or polycarbonate. These materials are offered only as examples since other materials may be used as well within the scope of the present invention. A basic requirement is that the material be structurally strong enough for the use in which it is intended and also sufficiently resilient to allow the tear-off seal to be pulled off easily. The parts can be manufactured by a conventional injection molding process and assembled together with the ammunition by known automatic machinery which is built for this very purpose.

While I have shown and described a preferred embodiment of my invention, it is to be clearly understood that the same is susceptible of numerous changes and modifications. For instance, the magazine and tear-off seal need not be constructed out of plastic or from one piece of material. Nor need the seal be hermetic. Likewise, the lower locking cap need not be ultrasonically welded to the magazine to effect the hermetic seal but can be merely snapped on. The tear-off seal at the cartridge dispensing end does not have to fully cover the dispensing end. Therefore, I do not intend to limit myself to the details shown and described herein but intend to cover all such changes and modifications as are encompassed by the scope of the appended claims.

I claim:

1. An ammunition magazine-package unit for use in firearms, including a hollow magazine body to receive ammunition for subsequent feeding at one end of the magazine body into a chamber of a firearm, means in the hollow body for biasing ammunition toward the dispensing end of the magazine, and a tamper-proof removable seal sealingly joined with the magazine body in the area of the dispensing end, the seal having a pull tab for removing the seal from the magazine body such that said seal breaks contact with the body in a progressive manner to expose an area designed to serve as an opening for feeding of the ammunition after removal of said seal.

2. An ammunition magazine-package unit according to claim 1, wherein the seal is integrally connected with the magazine body.

3. An ammunition magazine-package unit according to claim 1 or claim 2, wherein the magazine body and seal are made from a plastic material.

4. An ammunition magazine-package unit according to claim 2, wherein the seal includes a thinner web portion for integrally connecting the seal to the magazine body.

5. An ammunition magazine-package unit according to claim 4, wherein the web portion has a thickness of approximately 0.002 inches to 0.010 inches.

6. An ammunition magazine-package unit for use in firearms, including a hollow body which is adapted to receive ammunition for subsequent dispensing at one end of the magazine body into a chamber of a firearm, and a tear-off seal having a thinner web portion for integrally connecting the seal to the magazine body, wherein the tear-off seal is located at the ammunition dispensing end of the magazine body and, upon being pulled, is adapted to tear along the web to define an opening for effective dispensing of ammunition into a firearm chamber.

7. An ammunition magazine-package unit, including a hollow magazine body which is adapted to receive ammunition for subsequent feeding at one end of the magazine body into a chamber of a firearm, a removable seal associated with the magazine body to hermetically seal the contents in the body, and, wherein a cap is provided at the lower end of the magazine body subsequent to the loading of the ammunition and is hermetically sealed to the magazine body.

8. An ammunition magazine-package unit according to claim 7, wherein the seal is integrally connected with the magazine body.

9. An ammunition magazine-package and according to claim 8, wherein the seal is located at the ammunition dispensing end of the magazine body.

10. An ammunition magazine-package unit according to claim 9, where the magazine body and seal are made from a plastic material.

11. An ammunition magazine-package unit according to claim 10, wherein the seal includes a thinner web portion for is integrally connecting the seal to the magazine body.

12. An ammunition magazine-package unit according to claim 11, wherein the web portion has a thickness of approximately 0.002 inches to 0.010 inches.

13. An ammunition magazine-package unit according to claim 12, wherein the seal upon being pulled, is adapted to tear along the web to define an opening for effective dispensing of ammunition into a firearm chamber.

14. A magazine-package unit for use in firearms, including a hollow magazine body having one end adapted to dispense ammunition into a firearm chamber;

at least one round of ammunition operatively loaded in the magazine body;

and a tear-off seal located at the ammunition dispensing end of the magazine body and joined thereto through a relatively thinner web portion, whereby when the tear-off seal is pulled it will tear along the web to define the ammunition dispensing opening.

15. A magazine-package unit according to claim 14, wherein the web portion has a thickness of between about 0.002 and 0.010 inches, and the magazine body and tear-off seal are made from a plastic material.

* * * * *